US006507966B1

(12) United States Patent
Mitchell et al.

(10) Patent No.: US 6,507,966 B1
(45) Date of Patent: Jan. 21, 2003

(54) APPARATUS AND METHOD FOR COOKING AND DISPENSING STARCH

(75) Inventors: Wilson Wayne Mitchell, Rowlett, TX (US); Wesley Wayne Mitchell, Forney, TX (US)

(73) Assignee: Perfect Starch, Inc., Rowlett, TX (US)

( * ) Notice: Subject to any disclaimer, the term of this patent is extended or adjusted under 35 U.S.C. 154(b) by 78 days.

(21) Appl. No.: 09/831,764

(22) PCT Filed: May 31, 2000

(86) PCT No.: PCT/US00/15087

§ 371 (c)(1),
(2), (4) Date: May 14, 2001

(87) PCT Pub. No.: WO00/75412

PCT Pub. Date: Dec. 14, 2000

Related U.S. Application Data

(60) Provisional application No. 60/137,600, filed on Jun. 3, 1999.

(51) Int. Cl.[7] ..... D06F 39/02

(52) U.S. Cl. ..... 8/158; 68/17 R; 68/207; 127/28

(58) Field of Search ..... 68/17 R, 207; 134/93; 137/268; 127/28; 8/158

(56) References Cited

U.S. PATENT DOCUMENTS

| | | | | |
|---|---|---|---|---|
| 2,253,262 A | | 8/1941 | Bierly | 127/28 |
| 2,730,468 A | | 1/1956 | Martin | 127/28 |
| 2,805,966 A | | 9/1957 | Etheridge | 127/32 |
| 2,871,146 A | | 1/1959 | Etheridge | 127/28 |
| 2,919,214 A | | 12/1959 | Etheridge | 127/28 |
| 3,133,836 A | | 5/1964 | Winfrey et al. | 127/71 |
| 3,234,046 A | | 2/1966 | Etheridge | 127/28 |
| 3,424,613 A | | 1/1969 | Huber et al. | 127/28 |
| 3,485,667 A | | 12/1969 | Maurer | 127/28 |
| 3,527,606 A | * | 9/1970 | Taylor et al. | |
| 3,640,925 A | * | 2/1972 | Touzinsky et al. | |
| 3,661,640 A | | 5/1972 | Griffith et al. | 127/28 |
| 5,437,169 A | | 8/1995 | Mitchell et al. | 68/17 |
| 5,680,663 A | | 10/1997 | Mitchell et al. | 8/159 |
| 5,901,584 A | | 5/1999 | Mitchell et al. | 68/17 |
| 5,964,950 A | * | 10/1999 | Boling | |

* cited by examiner

*Primary Examiner*—Frankie L. Stinson
(74) *Attorney, Agent, or Firm*—John A. Thomas

(57) ABSTRACT

An apparatus for cooking and dispensing starch to laundry machines has a hopper (10) holding dry starch and a stirrer (15) and auger (25) for delivering predetermined amounts of dry starch to a mixing chamber (35) to be mixed with water. The mixing chamber (35) has a circulation pump (60) for circulating the starch and water mixture. A pressure pump (70) delivers starch and water mix from the mixing chamber (35) to a cooking chamber (80). The cooking chamber (80) also receives steam, which cooks the starch and water mix. A programmed computer (100) causes the apparatus to receive a request for starch from a laundry machine and dispense a predetermined amount of cooked starch to the requesting machine through one or more discharge valves (125) connected to a manifold (120). The computer (110) starts and stops the stirrer (15), auger (25), pressure pump (70), a steam valve (100), and discharge valves (125) to particular laundry machines in a programmed sequence.

22 Claims, 7 Drawing Sheets

APPARATUS AND METHOD FOR COOKING AND DISPENSING STARCH

CLAIM FOR PRIORITY

This application claims the benefit of the filing date of that certain United States provisional patent application disclosing the same invention, tiled "Simplified Apparatus and Method for Cooking and Dispensing Starch" and filed Jun. 3, 1999 under application Ser. No. 60/137,600.

TECHNICAL FIELD

Our invention relates to a method and apparatus for cooking laundry starch. More particularly, the invention relates to an apparatus and method for the cooking and dispensing of single batches of laundry starch which are cooked and discharged in consecutive single batches as needed to one or more commercial laundry machines.

BACKGROUND ART

The problems of existing starch cookers include insufficient agitation resulting in lumpy starch, inferior starching and starch build-up on press heads; overcooking the starch resulting in inferior starching of the garments; fouling of unused starch; and danger to employees from the manual transfer of hot starch solution from the starch cooker to the laundry machine. These problems were first addressed by the single-batch starch cooking and dispensing apparatus described in U.S. Pat. No. 5,437,169; and in the improvements and method described in U.S. Pat. No. 5,901,584.

DISCLOSURE OF INVENTION

We disclose an apparatus for cooking and dispensing starch to one or more laundry machines. The apparatus of the preferred embodiment comprises a hopper for holding dry starch, the hopper being positioned over a mixing chamber for mixing dry starch and water together to form a starch and water mixture. The hopper has a stirrer positioned within it, the stirrer being connected to a stirrer motor; and also an auger positioned with respect to the hopper so as to receive dry starch from the hopper and deliver a predetermined amount of dry starch to the mixing chamber. The auger has an auger motor to drive it. The mixing chamber has a circulation pump for circulating the starch and water mixture within the mixing chamber.

A pressure pump having an input and an output has its input connected to the mixing chamber. A cooking chamber has a fist opening connected to the output of the pressure pump, a second opening for receiving steam, and a third opening for discharge of cooked starch A steam valve is connected to the second opening of the cooking chamber, and a temperature-regulating valve connected to the steam valve; a source of steam connected to the temperature-regulating valve. A manifold is connected to the third opening of the cooking chamber, and a plurality of remotely-actuated discharge valves are connected to the manifold. The discharge valves are connected to a corresponding plurality of laundry machines.

A computer is operatively connected to the pressure pump and the steam valve; the computer being programmed to: respond to a signal from a laundry machine requesting starch, start the pressure pump a pre-determined time before opening the steam valve, stop the pressure pump a predetermined time after closing the steam valve, start the stirrer motor a predetermined time after opening the steam valve, stop the stirrer motor a predetermined time before closing the steam valve, start the auger motor a predetermined time after opening the steam valve, stop the auger motor a predetermined time before closing the steam valve, open the discharge valve connected to a laundry machine requesting cooked starch a predetermined time before starting the pressure pump, and, close the discharge valve connected to the laundry machine requesting cooked starch a predetermined after stopping the pressure pump.

Other embodiments of the invention may serve only one laundry machine; such embodiments may be directly connected to the laundry machine without connection to a manifold or discharge valve.

BEST MODE FOR CARRYING OUT THE INVENTION

Figure 1:
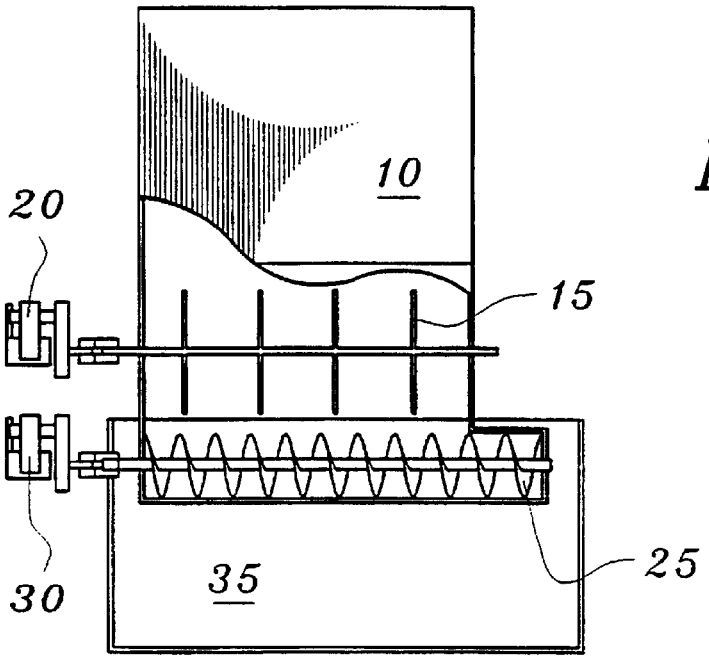
FIGS. 1 and 2 and show side views of the starch hopper with the stirrer for the dry starch, and the auger for delivering dry starch to the mixing chamber.
Figure 2:
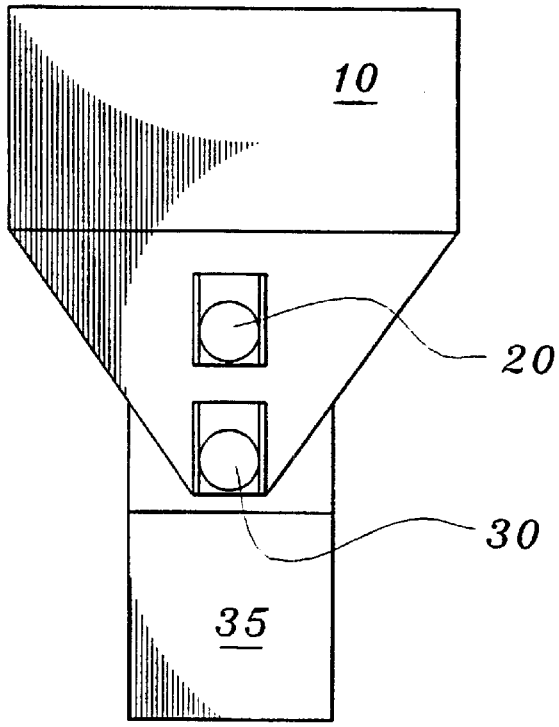
Figure 5:
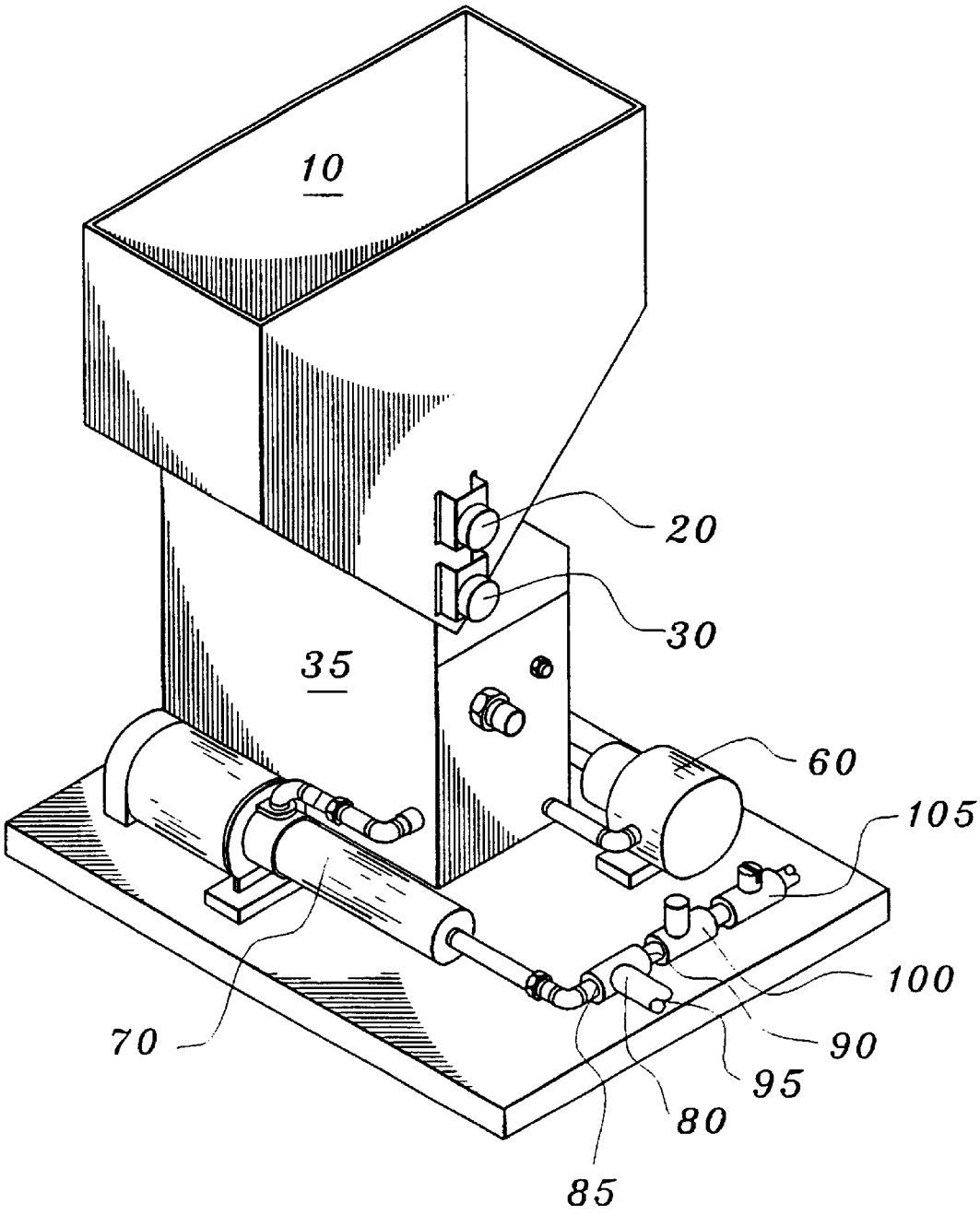
FIG. 5 is a perspective view of the preferred embodiment showing the hopper and mixing chamber assembled.

As shown in FIGS. 1 and 2, laundry starch is held in the hopper (10) to be dispensed into a mixing chamber (35). The hopper has mixing means, shown in FIG. 5 a stirrer motor (20), which turns one or more stirrers (15) to continuously keep the starch in the hopper (10) flowing freely into the auger (25). The stirrers (15) may be solid rods, flexible rods, or whips made of wire, chain, or cord. The auger (25) is turned by an auger motor (30). Both the auger motor (30) and the stirrer motor (20) are actuated selectively by the computer (110) described below. The auger (25) delivers starch from the hopper (10) into the mixing chamber (35). Typically, the auger (25) and the stirrers (15) will turn at about 20 r.p.m. The stirrer motor (20) and auger motor (30) start in the sequence described below.

Figure 3:
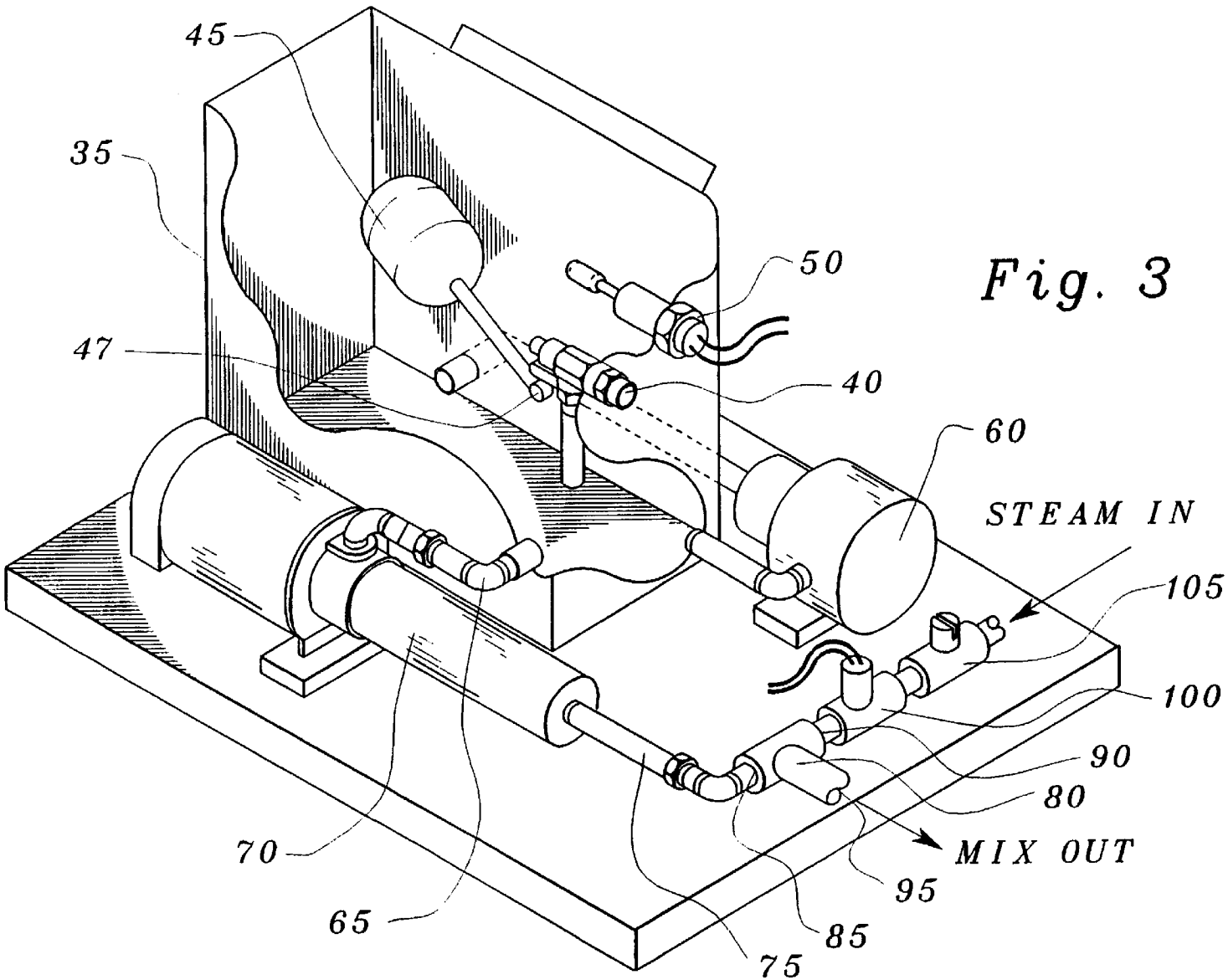
FIG. 3 is a perspective, cut-away view of the starch mixing chamber, pressure-building pump, mixing pump and starch cooking means of the preferred embodiment.

The stirrer motor (20) and the auger motor (30) will typically be timed to run between 4 seconds to 4 minutes, depending on the volume of starch needed by a laundry machine, as signaled by a computer (110), described below. For a request to supply sufficient starch for a medium starch cycle, the weight of dry starch dispensed by the auger (25) into the mixing chamber (35) will typically range between 0.456 kg (16 oz.) and 9.12 kg (320 oz.). For light starch these amounts will be half of this range, and for heavy starch, twice this range. The weight of starch required depends on the size of the laundry machine requesting starch with larger machines requiring more starch As shown in FIG. 3, The mixing chamber (35) receiving the starch from the hopper (10) is kept filled with water by means of a float switch (47) actuated by a level control (45).

Figure 4:
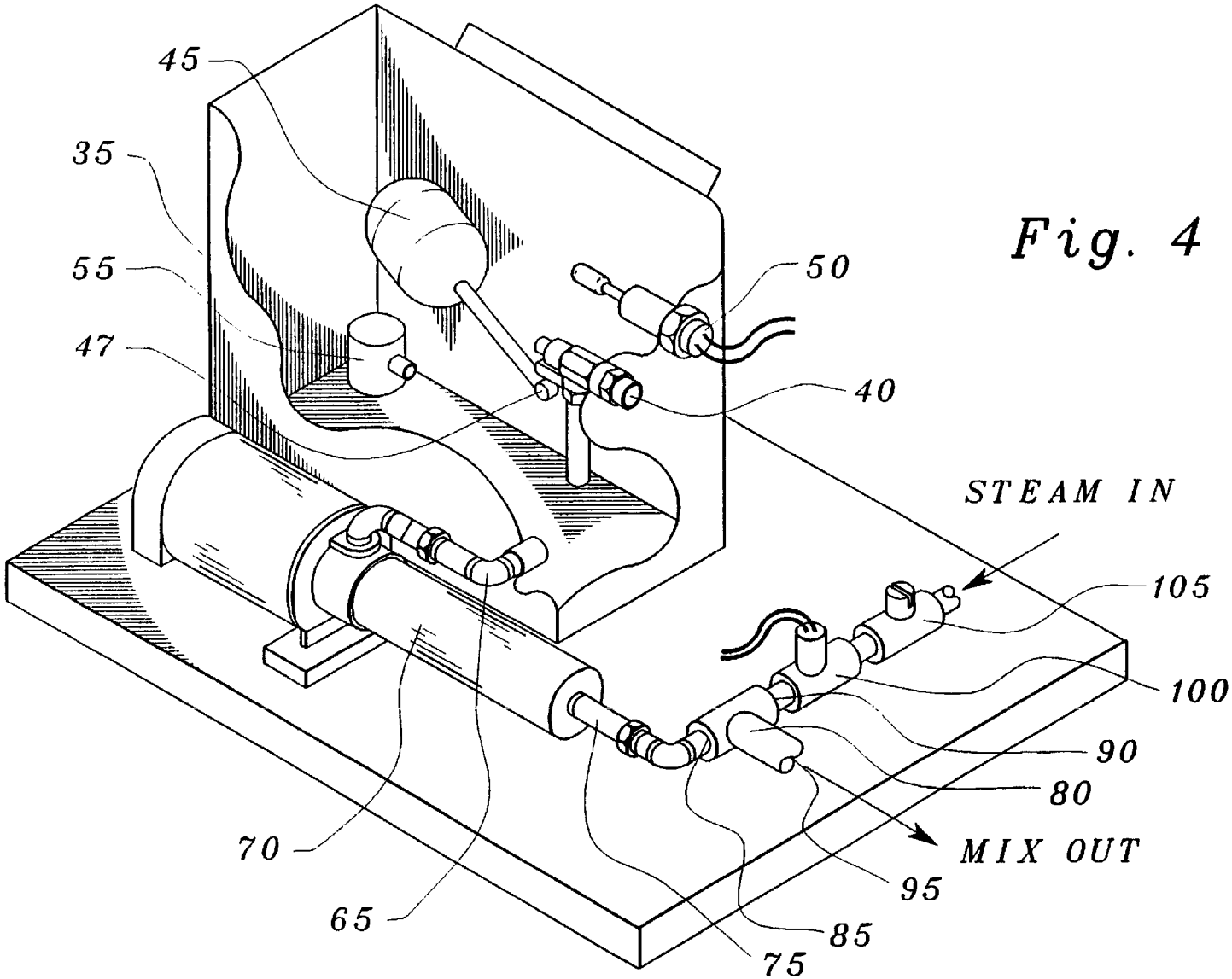
FIG. 4 is a perspective, cut-away view of the starch nixing chamber, pressure-building pump, mixing pump and starch cooking means, showing an alternate embodiment having a submersible mixing pump internal to the starch mixing chamber.

The water flows into the mixing chamber through a water inlet (50). Preferably, an overflow switch (50) responds to a potential overflow of the mixing chamber (35) should the float switch (47) fail to shut off inflowing water when the tank is full. An external mixing pump (60) runs to maintain the starch in suspension in the water. In another embodiment of the invention, shown in FIG. 4, the mixing chamber (35) contains at least one internal submersible mixing pump (55), which pump or pumps keep the starch and water mixed into a suspension. In the preferred embodiment these mixing pumps run continuously.

The starch-water suspension flows from the mixing chamber (35) through an outlet (75) to a pressure-building pump (70). This pressure pump (70) maintains the pressure of the starch-water suspension at approximately the pressure of typical city water systems. A suitable high-pressure gear pump is used in the preferred embodiment, although rotary vane pumps or a centrifugal pump may also be used. A typical flow from the pump is approximately 31 liters (10 gallons) per minute. The starch-water suspension flows from the pump outlet (75) to the first opening (85) of a cooking chamber (80). The preferred cooking chamber is a high-pressure stainless-steel pipe tee. It is important that the cooking chamber (80) have a sufficiently small volume to allow almost instant cooking of the starch and water mix as it encounters steam in the cooking chamber (80). Possible alternate cooking chambers could be valves or other pipe fittings or combinations, or specially formed chambers. The cooking chamber (80) also has a second opening (90) for receiving steam from a steam valve (100), and a third opening (95) for discharging cooked starch to remotely-actuated discharge valves (125) connected on a manifold (120) to one or more laundry machines. A suitable discharge valve (125) is a motor-actuated ball valve model SM24-SUS manufactured by Belimo. A suitable steam valve (100) is the solenoid-actuated RED HAT ASCO model 8220G25 manufactured by Automatic Switch Company. An adjustable temperature-regulating valve (105) is connected between the steam valve (100) and a source of steam The temperature-regulating valve (105) is preferably a ball valve or other valve having a manual adjustment, so that the volume of steam entering the steam valve (100) may be adjusted, and thus the temperature in the cooking chamber (80) set to its optimum value. The cooking chamber (80) can thereby be set for a pre-determined steam-water mix, and thus the temperature of the cooked starch output can be accurately controlled. For best results, the temperature of the starch-water suspension should be maintained between 85 degrees C. and 96 degrees C. (185 degrees F. and 205 degrees F.).

The computer (110) actuates the starch-cooking apparatus when a laundry machine connected to the computer (110) electrically signals a request for cooked starch. A line from the cooking chamber (80) may thus be kept charged with cooked starch-water suspension and deliver a batch of starch through this line to one or more laundry machines when each machine signals the control unit with a request for starch. Manual control of starch delivery from the cooking chamber (80) to a laundry machine is also possible by manual control of the circuits actuating the steam valve (100).

After the predetermined volume of cooked starch has been delivered to a laundry machine, the pressure pump (70) continues to run for a predetermined time to wash out the cooked starch solution from the lines. This time typically varies from 15 seconds to 2 minutes, depending on the size of the laundry machine. In the preferred embodiment, each laundry machine connected to the starch-cooking and dispensing apparatus may have its wash-out time set independently of other laundry machines, by programming the computer (110) though a user control panel (130).

Figure 6:
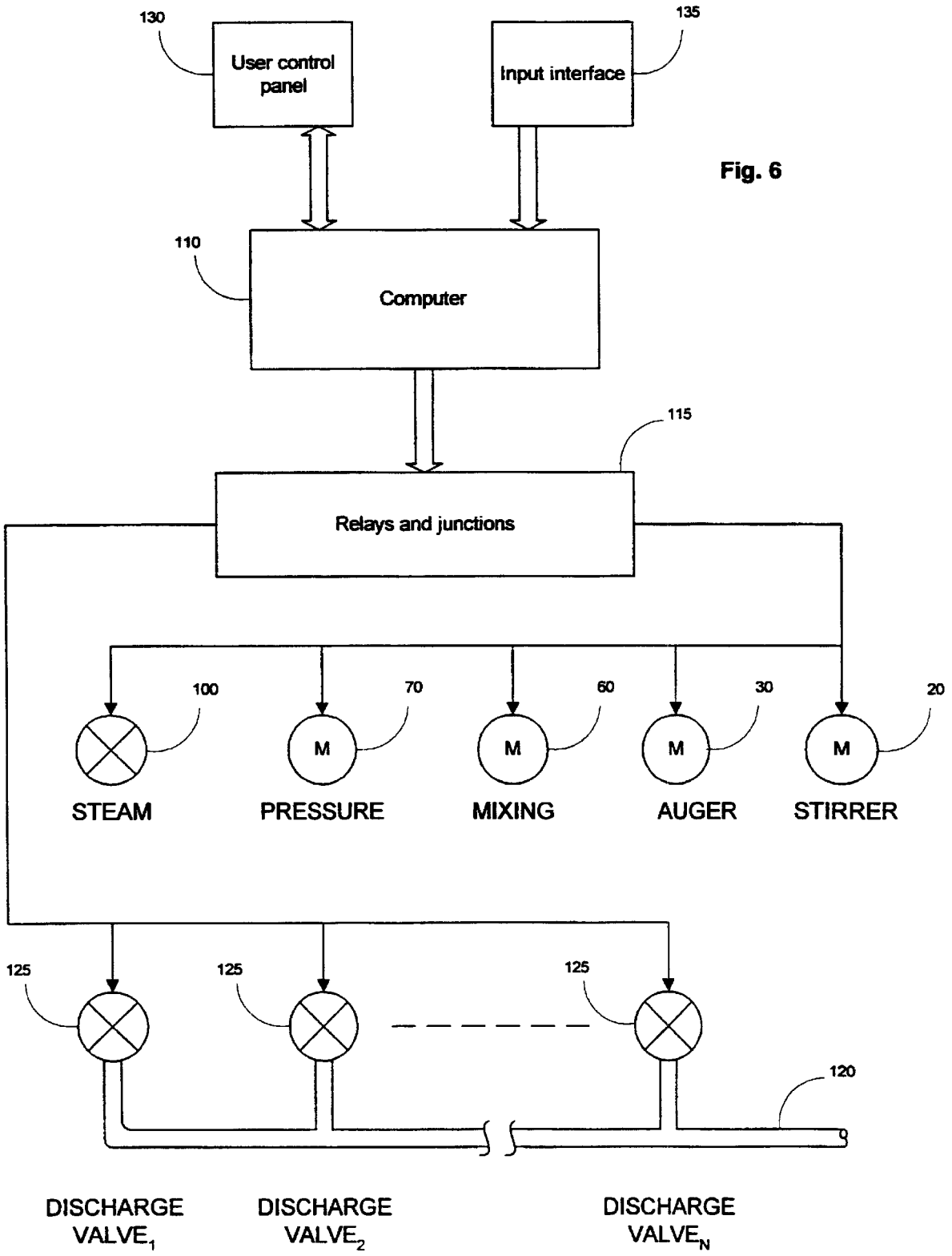
FIG. 6 is a schematic diagram of the typical connection of the computer control means to the preferred embodiment and a plurality of laundry machines.

FIG. 6 depicts the connection of the computer (110) to other functional elements of the preferred embodiment. A user control panel (130) allows users to program the parameters of starch weight, washout times, and the cycle times T1, T2, T3, T4, and T5, described below. An input interface (135) receives signals from laundry machines connected to the starch-cooking and dispensing apparatus. The input interface (135) converts the various high-level signals used by different laundry machines to a level compatible with low-level computer logic signals. A computer (110) is programmed to respond to the parameters set by the user at the user control panel (130), and to respond to the signals from one or more laundry machines connected to the input interface (135). Preferably, the computer (110) waits a predetermined interval such as 10 seconds to determine that an apparent start signal is valid and not line noise. In the preferred embodiment, the computer (110) is a programmed microcontroller, such as an 82C251 chip manufactured by the Intel Corporation. Other embodiments of the invention could use different programmed microcontrollers, or a general-purpose computer programmed to carry out the functions described in this disclosure, or the computer (110) could be a connection to a computer network having one or more computers programmed to carry out the functions described in this disclosure.

A bank of conventional relays and junctions (115) is connected to the computer (110) so as to provide a means for the relatively low-level signals typically found in computer systems to control power for the motors and valves of the starch-cooking apparatus. Solid-state relays are used in the preferred embodiment, although mechanical relays could also be used.

As further shown in FIG. 6, the bank of relays and junctions (115) is operatively connected to the steam valve (100), the pressure pump (70), the mixing pump (60), the auger motor (30), and the stirrer motor (20). Each discharge valve (125) associated with a particular laundry machine is operatively connected to the bank of relays and junctions (115), so that the discharge valve (125) may be opened and closed as described below. In the embodiment having only one laundry machine connected to the starch-cooking apparatus, no discharge valve (125) is required. Each discharge valve (125) is of course connected to the output of the cooking chamber (80) through the manifold (120).

Figure 7:
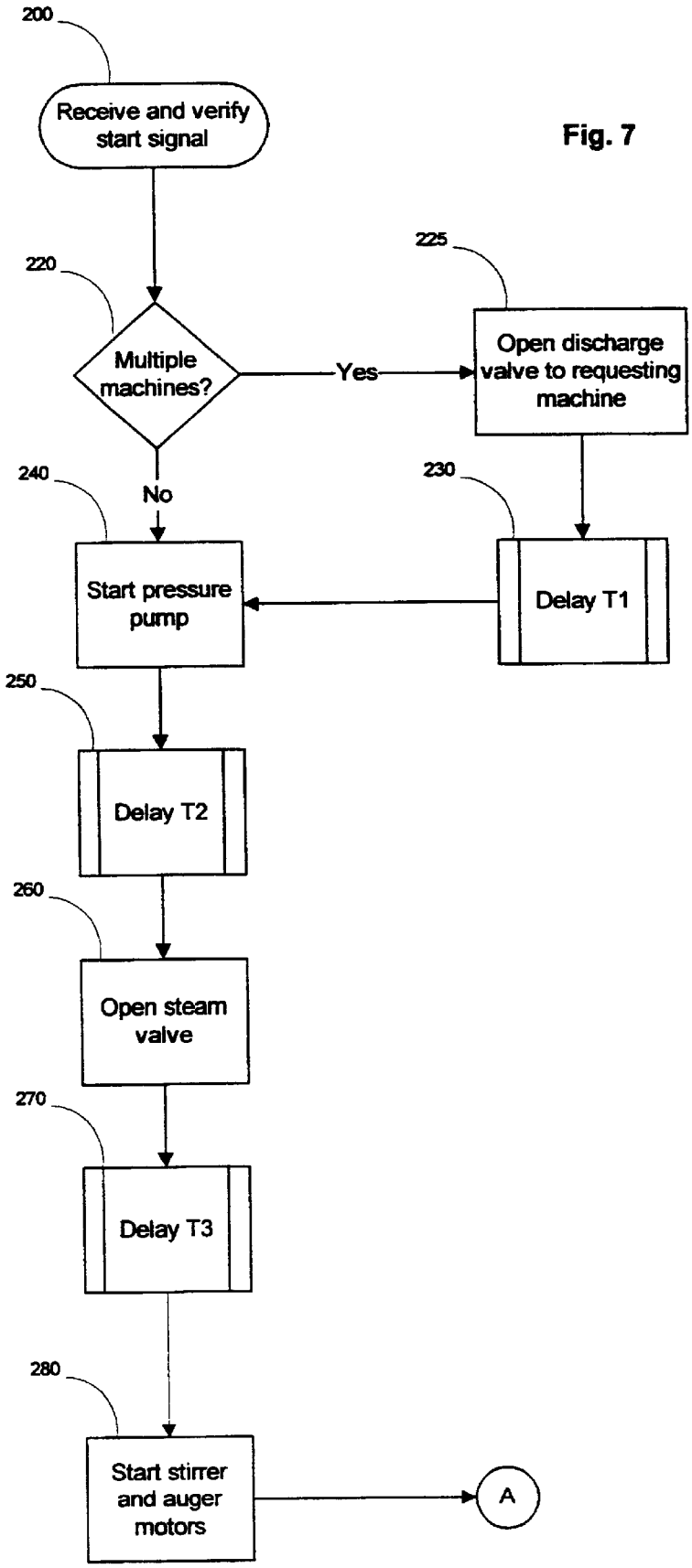
FIGS. 7 and 8 are a flow chart showing the flow of control implementing the timing method of the preferred embodiment.
Figure 8:
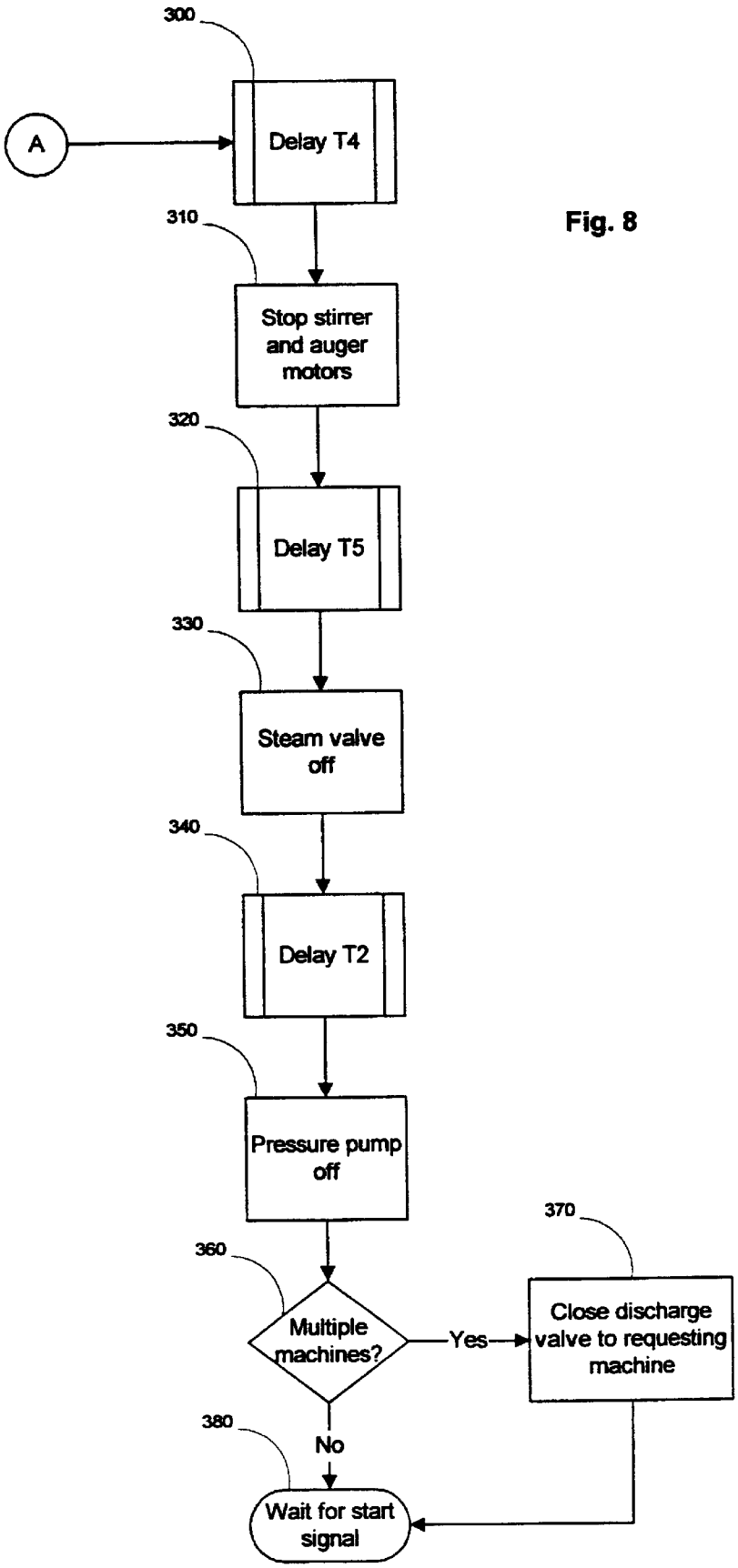

FIGS. 7 and 8 are flowcharts describing the flow of control in a cycle of the starch cooking apparatus. At (200) the computer (110) receives and verifies a start signal from a connected laundry machine. At (220) the computer (110) tests to see if the apparatus is connected to one or more machines. If the connection is to more than one machine on a manifold (120), the computer (110) at step (225) commands the opening of the discharge valve (125) associated with that machine. The computer (110) delays a time T1 at step (230). Time T1 is the time to allow substantially complete opening of the discharge valve (125). This time will be approximately 15 seconds for the valve used in the preferred embodiment. After delay T1, execution continues at step (240). If only one machine is connected to the apparatus, execution continues from step (220) to step (240), at which step the computer (110) commands the pressure pump to start.

After a delay, T2, the computer (110) at step (260) commands the steam valve (100) to open. Delay T2 is approximately 2 seconds in the preferred embodiment. After the computer (110) commands the steam valve (100) to open at step (260), the computer (110) delays time T3. T3 should be about 10 seconds, so as to allow the steam and the cooking chamber (80) to reach optimal cooking temperature. The computer (110) then commands the start of the stirrer and auger motors (20 and 30).

At this point in the process, starch and water suspension and steam are flowing into the cooking chamber (80), being cooked, and conveyed through the third opening (95) of the cooking chamber (80) to the requesting laundry machine. This process continues for a time T4 at step (300). Time T4 will range from 4 seconds to 4 minutes, depending on the predetermined amount of starch programmed into the computer (110) for the machine requesting starch After delay T4, the computer (110) commands the stirrer and auger motors (20 and 30) to stop at step (310). After this time the computer (110) commands a delay, T5, at step (320). Delay T5 allows the pressure pump (70) to continue operation for a time sufficiently long to wash excess starch and water mix from the lines connecting the apparatus with the laundry machine. This time will vary from approximately 15 seconds to 2 minutes and is dependent upon the size of the connected laundry machine. The user programs time T5 into the computer (110).

After delay T5, the computer (110) commands the steam valve (100) to shut at step (330). At step (340), the computer (110) commands a delay of time T2 again to allow the steam valve to close, and commands the pressure pump (70) to turn off at step (350). A test is made at step (360) to determine if the apparatus is connected to multiple machines. If so, at step (370) the computer (110) commands the respective discharge valve (125) to close. In either case, execution returns to step (380), where the computer (110) is waiting for another start signal from a laundry machine.

We direct the reader's attention to all papers and documents filed concurrently with or previous to this specification in connection with this application and which are open to public inspection with this specification and the contents of all such papers and documents are incorporated herein by reference.

What is claimed is:

1. An apparatus for cooking and dispensing starch to a laundry machine, the apparatus comprising:

a. a mixing chamber for mixing dry starch and water together to form a starch and water mixture;

b. a pressure pump having an input and an output, the pressure pump having its input connected to the mixing chamber;

c. a cooking chamber, the cooking chamber having a first opening connected to the output of the pressure pump, a second opening for receiving steam, and a third opening for discharge of cooked starch;

d. a steam valve connected to the second opening of the cooking chamber;

e. a temperature-regulating valve connected to the steam valve;

f. a source of steam connected to the temperature-regulating valve; and, g. a computer operatively connected to the pressure pump and the steam valve, the computer being programmed to start the pressure pump a pre-determined time before opening the steam valve, and to stop the pressure pump a predetermined time after closing the steam valve.

2. The apparatus of claim 1 where the apparatus further comprises an auger connected to an auger motor for dispensing a predetermined amount of dry starch into the mixing chamber.

3. The apparatus of claim 2 where the computer starts the auger motor a predetermined time after opening the steam valve.

4. The apparatus of claim 2 where the computer stops the auger motor a predetermined time before closing the steam valve.

5. The apparatus of claim 1 where the apparatus further comprises a stirrer connected to a stirrer motor for maintaining a smooth flow of dry starch into the mixing chamber.

6. The apparatus of claim 5 where the computer starts the stirrer motor a predetermined time after opening the steam valve.

7. The apparatus of claim 5 where the computer stops the stirrer motor a predetermined time before closing the steam valve.

8. The apparatus of claim 1 further comprising at least one circulation pump internal to the mixing chamber, for circulating the starch and water mixture within the mixing chamber.

9. The apparatus of claim 1 further comprising a least one circulation pump external to the mixing chamber for circulating the starch and water mixture within the mixing chamber.

10. The apparatus of claim 1 where the computer is responsive to a signal from a laundry machine requesting starch.

11. An apparatus for cooking and dispensing starch to one or more laundry machines, the apparatus comprising:

a. a mixing chamber for mixing dry starch and water together to form a starch and water mixture;

b. a pressure pump having an input and an output, the pressure pump having its input connected to the mixing chamber;

c. a cooking chamber, the cooking chamber having a first opening connected to the output of the pressure pump, a second opening for receiving steam, and a third opening for discharge of cooked starch;

d. a steam valve connected to the second opening of the cooking chamber;

e. a temperature-regulating valve connected to the steam valve;

f. a source of steam connected to the temperature-regulating valve;

g. a manifold connected to the third opening of the cooking chamber;

h. one or more discharge valves connected to the manifold, each of the discharge valves connected to a corresponding laundry machine;

i. a computer operatively connected to the pressure pump, the steam valve, and the discharge valves; the computer being programmed to start the pressure pump a predetermined time before opening the steam valve, and to stop the pressure pump a predetermined time after closing the steam valve; and further to open the discharge valve connected to a laundry machine requesting cooked starch a predetermined time before starting the pressure pump, and to close the discharge valve connected to the laundry machine requesting cooked starch a predetermined after stopping the pressure pump.

12. The apparatus of claim 11 where the apparatus further comprises an auger connected to an auger motor for dispensing a predetermined amount of dry starch into the mixing chamber.

13. The apparatus of claim 11 where the computer starts the auger motor a predetermined time after opening the steam valve.

14. The apparatus of claim 13 where the computer stops the auger motor a predetermined time before closing the steam valve.

15. The apparatus of claim 11 where the apparatus further comprises a stirrer connected to a stirrer motor for maintaining a smooth flow of dry starch into the mixing chamber.

16. The apparatus of claim 15 where the computer starts the stirrer motor a predetermined time after opening the steam valve.

17. The apparatus of claim 15 where the computer stops the stirrer motor a predetermined time before closing the steam valve.

18. The apparatus of claim 11 further comprising at least one circulation pump internal to the mixing chamber, for circulating the starch and water mixture within the mixing chamber.

19. The apparatus of claim 11 further comprising a least one circulation pump internal to the mixing chamber for circulating the starch and water mixture within the mixing chamber.

20. The apparatus of claim 11 where the computer is responsive to a signal from a dry machine requesting starch.

21. An apparatus for cooking and dispensing starch to one or more laundry machines, the apparatus comprising:

a. a hopper for holding dry starch, the hopper positioned over a mixing chamber for mixing dry starch and water together to form a starch and water mixture;

b. a stirrer positioned within the hopper, the stirrer connected to a stirrer motor;

c. an auger positioned with respect to the hopper so as to receive dry starch from the hopper and deliver a predetermined amount of dry starch to the mixing chamber; the auger having an auger motor;

d. a circulation pump for circulating the starch and water mixture within the mixing chamber;

e. a pressure pump having an input and an output, the pressure pump having its input connected to the mixing chamber;

f. a cooking chamber, the cooking chamber having a first opening connected to the output of the pressure pump, a second opening for receiving steam, and a third opening for discharge of cooked starch;

g. a steam valve connected to the second opening of the cooking chamber;

h. a temperature-regulating valve connected to the steam valve;

i. a source of steam connected to the temperature-regulating valve;

j. a manifold connected to the third opening of the cooking chamber;

k. a plurality of discharge valves connected to the manifold, the discharge valves further connected to a corresponding plurality of laundry machines;

l. a computer operatively connected to the pressure pump and the steam valve, the computer being programmed to:

(1) respond to a signal from a laundry machine requesting starch, (2) start the pressure pump a pre-determined time before opening the steam valve, (3) stop the pressure pump a predetermined time after closing the steam valve, (4) start the stirrer motor a predetermined time after opening the steam valve, (5) stop the stirrer motor a predetermined time before closing the steam valve, (6) start the auger motor a predetermined time after opening the steam valve, (7) stop the auger motor a predetermined time before closing the steam valve, (8) open the discharge valve connected to a laundry machine requesting cooked starch a predetermined time before starting the pressure pump, and, (9) close the discharge valve connected to the laundry machine requesting cooked starch a predetermined after stopping the pressure pump.

22. A method for cooking and dispensing starch to one or more laundry machines, comprising the steps of:

a. receiving a start signal from a laundry machine requesting cooked starch;

b. opening a discharge valve to the requesting machine;

c. delaying for a first time sufficient to allow the discharge valve to open;

d. starting a pressure pump;

e. opening a steam valve connected to a cooking chamber;

f. delaying for a time sufficient for the cooking chamber to reach optimum cooking temperature;

g. starting motors for a stirrer of dry starch, and an auger for delivering dry starch to a mixing chamber;

h. delaying for a time sufficient to allow a cooked starch mixture to be dispensed to the requesting laundry machine;

i. stopping the stirrer and auger motors;

j. delaying for a time sufficient to wash excess cooked starch from lines connecting the cooking chamber and the requesting laundry machine;

k. turning off the steam valve;

l. turning off the pressure pump; and, m. closing the discharge valve.

* * * * *

UNITED STATES PATENT AND TRADEMARK OFFICE

CERTIFICATE OF CORRECTION

PATENT NO. : 6,507,966 B1 
DATED : January 21, 2003
INVENTOR(S) : Wilson Wayne Mitchell and Wesley Wayne Mitchell It is certified that error appears in the above-identified patent and that said Letters Patent is hereby corrected as shown below:

Column 1,
Line 49, the word “fist” should be -- first --;
Line 51, a period should appear after the words “cooked starch”;

Column 3,
Line 39, a periond should appear after the words “source of steam”;

Column 4,
Line 2, the word “though” should be -- through --;

Column 6,
Line 22, the word “a” should be -- at --;
Line 62, after the word “predetermined”, the word -- time -- should be inserted;

Column 7,
Line 25, the word “dry” should be changed to -- lanudry -- ; and

Column 8,
Line 26, the word “predetermined” should be followed by the word -- time --.

Signed and Sealed this

Sixteenth Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,507,966 B1 
DATED : January 21, 2003
INVENTOR(S) : Wilson Wayne Mitchell and Wesley Wayne Mitchell It is certified that error appears in the above-identified patent and that said Letters Patent is hereby corrected as shown below:

Column 1,
Line 49, the word “fist” should be -- first --;
Line 51, a period should appear after the words “cooked starch”;

Column 3,
Line 39, a period should appear after the words “source of steam”;

Column 4,
Line 2, the word “though” should be -- through --;

Column 6,
Line 22, the word “a” should be -- at --;
Line 62, after the word “predetermined”, the word -- time -- should be inserted;

Column 7,
Line 25, the word “dry” should be changed to -- laundry -- ; and

Column 8,
Line 26, the word “predetermined” should be followed by the word -- time --.

Signed and Sealed this

Twenty-first Day of October, 2003

JAMES E. ROGAN
*Director of the United States Patent and Trademark Office*